US011976557B2

(12) United States Patent
Zhu et al.

(10) Patent No.: US 11,976,557 B2
(45) Date of Patent: May 7, 2024

(54) COAL BUMP CONTROL METHOD FOR SECTIONAL HYDRAULIC FRACTURING REGIONS OF NEAR VERTICAL ULTRA THICK COAL SEAM

(71) Applicants: University of Science and Technology Beijing, Beijing (CN); North China Institute of Science and Technology, Langfang (CN); Beijing Anke Xingye Science and Technology Co., Ltd., Beijing (CN)

(72) Inventors: Sitao Zhu, Beijing (CN); Gaoang Wang, Beijing (CN); Fuxing Jiang, Beijing (CN); Gang Yao, Beijing (CN); Tao Zhou, Beijing (CN); Jinhai Liu, Beijing (CN); Huan Li, Beijing (CN); Zhen Kong, Beijing (CN); Qingbo He, Beijing (CN); Xiaocheng Qu, Beijing (CN); Quande Wei, Beijing (CN); Yitong Huang, Beijing (CN); Shaohua Sun, Beijing (CN)

(73) Assignees: University of Science and Technology Beijing, Beijing (CN); North China Institute of Science and Technology, Langfang (CN); Beijing Anke Xingye Science and Technology Co., Ltd., Beijing (CN)

( * ) Notice: Subject to any disclaimer, the term of this patent is extended or adjusted under 35 U.S.C. 154(b) by 0 days.

(21) Appl. No.: 17/890,406

(22) Filed: Aug. 18, 2022

(65) Prior Publication Data

US 2023/0160305 A1 May 25, 2023

(30) Foreign Application Priority Data

Nov. 23, 2021 (CN) ..... 202111397956.6

(51) Int. Cl.
*E21C 37/12* (2006.01)

(52) U.S. Cl.
CPC ..... *E21C 37/12* (2013.01)

(58) Field of Classification Search
CPC ..... E21C 37/12; E21C 41/18
See application file for complete search history.

(56) References Cited

FOREIGN PATENT DOCUMENTS

CN 204678995 U * 9/2015
CN 105804750 A * 7/2016

OTHER PUBLICATIONS

Zhang, et al. Roof Fractures of Near-Vertical and Extremely Thick Coal Seams in Horizontally Grouped Top-Coal Drawing Method Based on the Theory of a Thin Plate Sustainability 2022, 14, 10285. https://doi.org/10.3390/su141610285 (Year: 2022).*

(Continued)

*Primary Examiner* — Janine M Kreck
(74) *Attorney, Agent, or Firm* — Janeway Patent Law PLLC; John M. Janeway

(57) ABSTRACT

The present disclosure provides a coal bump control method for sectional hydraulic fracturing regions of a near vertical ultra thick coal seam. The method includes: deepening a main shaft from a mining level to a fracturing level; excavating a cross-hole from a roof rock layer of a coal seam at the fracturing level to enter a coal seam being mined, and excavating a roadway along the strike of the coal seam; and drilling hydraulic fracturing boreholes in a dedicated fracturing roadway along an inclination angle of the coal seam to the coal seam above the roadway, wherein the length of the borehole makes the borehole in communication with a goaf, and the spacing of the boreholes along the strike and the sectional spacing of the boreholes in an inclination direction are designed according to the parameters of fracturing equipments and the fracturing length.

8 Claims, 4 Drawing Sheets

(56) References Cited

OTHER PUBLICATIONS

Qin, et al. Occurrence Characteristic and Mining Technology of Ultra-thick Coal Seam in Xinjiang, China Sustainability 2019, 11, 6470; doi:10.3390/su11226470 (Year: 2019).*

* cited by examiner

COAL BUMP CONTROL METHOD FOR SECTIONAL HYDRAULIC FRACTURING REGIONS OF NEAR VERTICAL ULTRA THICK COAL SEAM

CROSS REFERENCE TO RELATED APPLICATION

This patent application claims the benefit and priority of Chinese Patent Application No. 202111397956.6, filed on Nov. 23, 2021, the disclosure of which is incorporated by reference herein in its entirety as part of the present application.

TECHNICAL FIELD

The present disclosure relates to the technical field of shock bump disaster prevention and control, and in particular, to a coal bump control method for sectional hydraulic fracturing regions of near vertical ultra thick coal seam.

BACKGROUND ART

Since the sedimentary structures and the geologic structures of coal-rock seams of a near vertical coal seam are special, and the thickness of the coal seam is great, the evolution of a stress field and an energy field is complex during coal mining, which extremely easily induces shock bump in mining faces. Therefore, the research on the prevention and control of shock bump in the near vertical coal seam has become an urgent engineering problem to be solved in safety production of coal mine.

At present, the existing prevention and control ideas and technical solutions mainly perform pressure relief treatment by blasting to rock pillars between coal seams and stoping coal body on working faces. The prior art discloses that water injection softening and pressure relief blasting are performed on coal seams in a stoping stage at inning levels, and the water injection softening and the pressure relief blasting are performed on rock pillars, and roof rock layers and floor rock layers of the coal seams at the mining levels, which have the characteristic that pressure relief prevention and control are performed for a coal rocks at the mining levels. In addition, the prior art discloses that a plurality of rows of deep blasting holes and shallow blasting holes are arranged alternately to perform pressure relief treatment on the roof rock layers and the floor rock layers at the mining levels, which has the characteristic that energy consumption and shock bump reduction are performed for hard roofs and hard floors of coal seams at the mining levels. At present, the research on the prevention and control of shock bump in mining the near vertical coal seam has made some achievements. However, the prevention and control solutions are mainly local shock bump prevention technical measures, the shock bump prevention focuses on the treatment of the coal body and the roof-floor rocks in a mining stage, the construction quantity is large, and the shock bump on the near vertical coal seam is not solved fundamentally.

The present disclosure provides a coal bump control method for sectional hydraulic fracturing regions of a near vertical ultra thick coal seam, which performs hydraulic fracturing on high-stress coal body to relieve pressure before mining on working faces, fractures a plurality of the coal bodies in an unmined stage across horizontal sections, and releases the elastic energy of the coal body in advance, so as to achieve the purpose of regional prevention and control of the shock bump.

SUMMARY

In order to solve the problem that the effect of preventing and controlling shock bump in blasting rock pillars between coal seams of a near vertical coal seam is not ideal, the present disclosure provides a coal bump control method for sectional hydraulic fracturing regions of a near vertical ultra thick coal seam.

The method includes the following steps:

S1: deepening a main shaft from a mining level to a fracturing level;

S2: excavating a cross-hole from a roof rock layer of a coal seam at the fracturing level to enter a coal seam being mined, and excavating a roadway along a strike of the coal seam at the fracturing level to serve as a dedicated roadway for hydraulic fracturing construction, that is, a fracturing roadway;

S3: constructing inclined fracturing boreholes from the fracturing roadway to an upper coal seam, wherein the boreholes are ended at a center of the thickness of the upper coal seam, the angle α and the length L of each fracturing borehole are obtained from the thickness d of the coal seam and the vertical distance H according to following formulas, $$\tan\alpha = H/\left(\frac{d}{2}\right)$$

$$L = \sqrt{H^2\left(\frac{d}{2}\right)^2}$$

in the formulas: α is the angle of each fracturing borehole, H is the vertical distance between the mining level of the coal seam and a goaf above the coal seam, and d is the thickness of the coal seam, the sectional height l of each fracturing borehole is obtained by the power of fracturing equipments and the length L of each fracturing borehole according to following formula:

$$n=L/R$$

$$l=H/n$$

in the formulas: l is the sectional height of each fracturing borehole, R is a single maximum fracture radius of the fracturing equipments, n is the number of fracturing sections, L is the length of each fracturing borehole, and H is the vertical distance between the mining level of the coal seam and the goaf above the coal seam:

S4: arranging the fracturing boreholes in a row spacing from a cutting hole of a stoping face to stop line in sequence along the strike of the coal seam, wherein the row spacing of the fracturing boreholes is designed according to the parameters of the fracturing equipments;

S5: operating the fracturing equipments to perform inclined sectional hydraulic fracturing on a coal body with high elastic energy in one of the fracturing boreholes;

S6: moving the fracturing equipments along the strike of the coal seam after a fracturing operation of a first fracturing section is completed, performing the fracturing operation of a next fracturing section according to the designed row spacing of the fracturing boreholes in the same manner as for the first fracturing section until all of the fracturing boreholes have been performed with the fracturing operation, to complete the fracturing operations of the coal body with high elastic energy on the mining face; and S7: after the fracturing operations are completed, remaining the fracturing roadway as a stoping roadway of the fracturing level according to a principle that one roadway has a plurality of purposes.

In a further embodiment, in S1, deepening the main shaft to a level which has the vertical depth of 100 in away from the mining level, and weakening a high-stress coal seam of the overall level in advance.

In a further embodiment, in S3, constructing the fracturing boreholes in the fracturing roadway to perform the hydraulic fracturing before stoping on a working face of a current mining stage.

In a further embodiment, in S3, under the pressing and prying action of rock pillars between coal seams, the stress concentration degree of the coal body the stoping face is high, a main fracturing object is the coal body, the length of each fracturing borehole makes the each fracturing borehole in communication with the goaf, the fracturing range is the overall thickness of the coal seam, and the sectional height of each fracturing borehole is 20 m under the limitation of the fracturing equipments.

In a further embodiment, in S4, the row spacing of the boreholes is arranged along the strike, and the row spacing of the boreholes is two times bigger than the fracturing radius.

In a further embodiment, in S5, during hydraulic fracturing, when a pressure of a water injection pump rises to a fracturing pressure of the coal body, maintaining a discharge pressure of the water injection pump to expand fractures. When the discharge pressure of the water injection pump suddenly rises from a continuously stable value to another value at which the discharge pressure does not change any longer, ending a fracturing operation of the first fracturing section.

In a further embodiment, in S6, the fracturing operation occurs earlier than the stoping operation occurs on the working face, and the fracturing operation is at least 200 m ahead of the stoping face.

In a further embodiment, in S7, after the fracturing operation is completed, closing the fracturing roadway after support for the fracturing roadway is strengthened such that the fracturing roadway is configured as a stoping roadway to be operated when the coal seam at the fracturing level is mined in stages, so as to reduce the construction cost.

The abovementioned technical solution of the present disclosure has the following beneficial effects:

in the abovementioned solution, the coal body at a lower part of a horizontal working face is mined through sectional hydraulic fracturing, so that high elastic energy accumulated in the coal body is released, the stress concentration degree of bottom coals is reduced, the purpose of preventing and controlling the shock bump of mining bottom coals of the near vertical coal seam is achieved, and safe and efficient mining of the near vertical coal seam is ensured.

Figure 1:
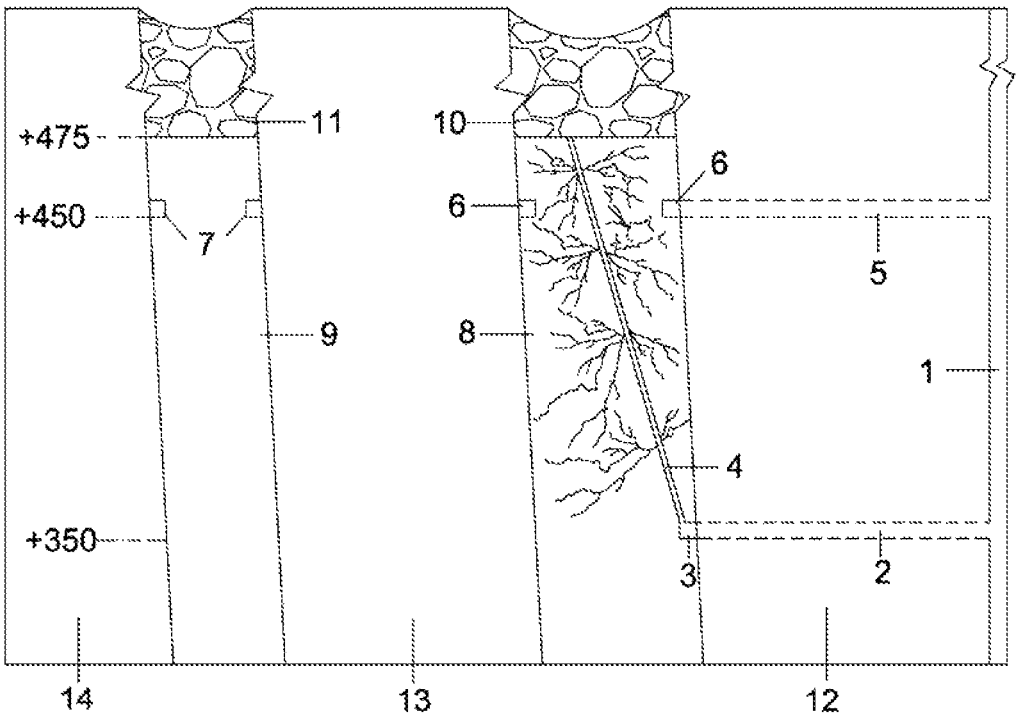
FIG. 1 is a construction process view of a coal bump control method for sectional hydraulic fracturing regions of a near vertical ultra thick coal seam of the present disclosure.

Reference signs in the drawings: 1—main shaft; 2—fracturing roadway connecting cross-hole; 3—fracturing roadway; 4—fracturing borehole; 5—stoping roadway connecting cross-hole; 6—stoping roadway of coal seam being mined; 7—stoping roadway of coal seam to be mined; 8—coal seam being mined; 9—coal seam to be mined; 10—goaf of coal seam being mined; 11—goaf of coal seam to be mined; 12—roof rock layer; 13—rock pillar between coal seams; 14—floor rock layer; 15—hole packer; 16—water tank; 17—pump; 18—shut-off valve; 19—tee joint; 20—pressure gauge; 21—pressure sensor; 22—diameter variable joint; 23—straight joint; 24—water injection fracturing pipe; and 25—hole packer pressurizing pipe.

DETAILED DESCRIPTION OF THE EMBODIMENTS

To make the technical problems to be solved, technical solutions, and advantages of the present disclosure clearer, detailed description is made below in combination with the accompanying drawings and embodiments.

The present disclosure provides a coal bump control method for sectional hydraulic fracturing regions of a near vertical ultra thick coal seam.

The method includes the following steps:

S1: deepening a main shaft from a mining level to a fracturing level;

S2: excavating a cross-hole from a roof rock layer of a coal seam at the fracturing level to enter a coal seam being mined, and excavating a roadway along the strike of the coal seam at the fracturing level to serve as a dedicated roadway for hydraulic fracturing construction, that is, a fracturing roadway;

S3: constructing inclined fracturing boreholes from the fracturing roadway to the upper coal seam, wherein the boreholes are ended at the center of the thickness of the upper coal seam, and the angle α and the length L of each fracturing borehole are obtained from the thickness d of the coal seam and the vertical distance H according to following formulas.

$$\tan\alpha = H/\left(\frac{d}{2}\right)$$

$$L = \sqrt{H^2\left(\frac{d}{2}\right)^2}$$

in the formulas: α is the angle of each fracturing borehole, H is the vertical distance between the mining level of the coal seam and a goaf above the coal seam, and d is the thickness of the coal seam:

a sectional height l of each fracturing borehole is obtained by the power of fracturing equipments and the length L of each fracturing borehole according to following formulas.

$$n=L/R$$

$$l=H/n$$

in the formulas: l is the sectional height of each fracturing borehole, R is a single maximum fracture radius of the fracturing equipments, n is the number of fracturing sections, L is the length of each fracturing borehole, and H is the vertical distance between the mining level of the coal seam and the goaf above the coal seam.

S4: arranging the fracturing boreholes in row spacing from cutting hole of stoping face to stop line in sequence along the strike of the coal seam, wherein the row spacing of the fracturing boreholes is designed according to the parameters of the fracturing equipments.

S5: operating the fracturing equipments to perform inclined sectional hydraulic fracturing on a coal body with high elastic energy in one of the fracturing boreholes.

S6: moving the fracturing equipments along the strike of the coal seam after a fracturing operation of a first fracturing section is completed, performing the fracturing operation of a next fracturing section according to the designed row spacing of the fracturing boreholes in the same manner as for the first fracturing section until all of the fracturing boreholes have been performed with the fracturing operation, to complete the fracturing operations of the coal body with high elastic energy on the mining face.

S7: after the fracturing operations are completed, remaining the fracturing construction roadway as a stoping roadway of the fracturing level according to a principle that one roadway has a plurality of purposes.

The present disclosure will be described below in combination with a specific implementation mode.

Figure 2:
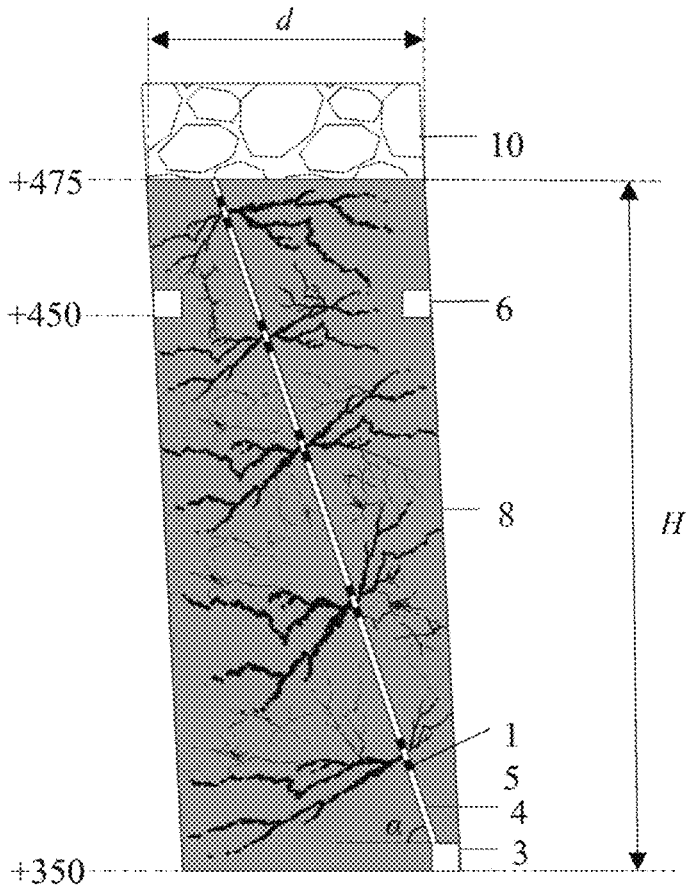
FIG. 2 is a sectional view of a sectional hydraulic fracturing construction process of the near vertical ultra thick coal seam of the present disclosure.
Figure 3:
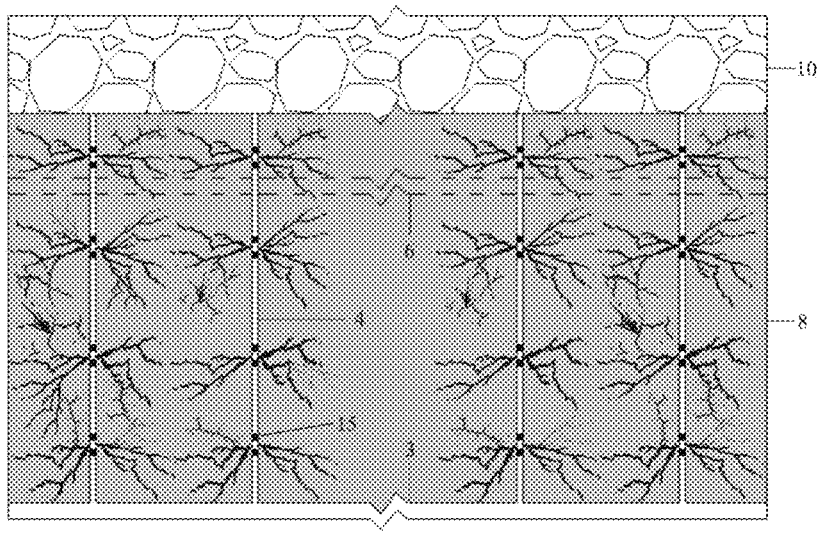
FIG. 3 is a plane view of the sectional hydraulic fracturing construction process of the near vertical ultra thick coal seam of the present disclosure.

As shown in FIG. 1, FIG. 2, and FIG. 3, in a specific implementation process, the method is implemented according to the following steps:

S1: deepening a main shaft 1 to a level which has the vertical depth of 100 m away from a stoping face, excavating a fracturing roadway connecting cross-hole 2 in the main shaft 1 from a roof rock layer 12 of a coal seam at a fracturing level to enter a mining coal seam, and simultaneously, excavating a stoping roadway connecting cross-hole 5 to a stoping roadway 6 of coal seam being mined.

S2: excavating a roadway along the strike of the coal seam at the fracturing level to serve as a dedicated roadway for hydraulic fracturing construction, that is, a fracturing roadway 3.

S3: constructing inclined fracturing boreholes 4 from the roof of the fracturing roadway to the upper part of a mining level, constructing obliquely upward fracturing boreholes in the fracturing roadway to the upper coal seam along the strike vertical to the working face, wherein the length of each fracturing borehole makes the each fracturing borehole in communication with a goaf 10 of coal seam being mined, and the fracturing range is the overall thickness of the coal seam being mined 8.

S4: arranging the fracturing boreholes 4 in a row spacing from cutting hole of stoping face to stop line along the strike of the coal seam in the fracturing roadway 3, and the row spacing of the fracturing boreholes 4 is two times bigger than the fracturing radius.

Figure 4:
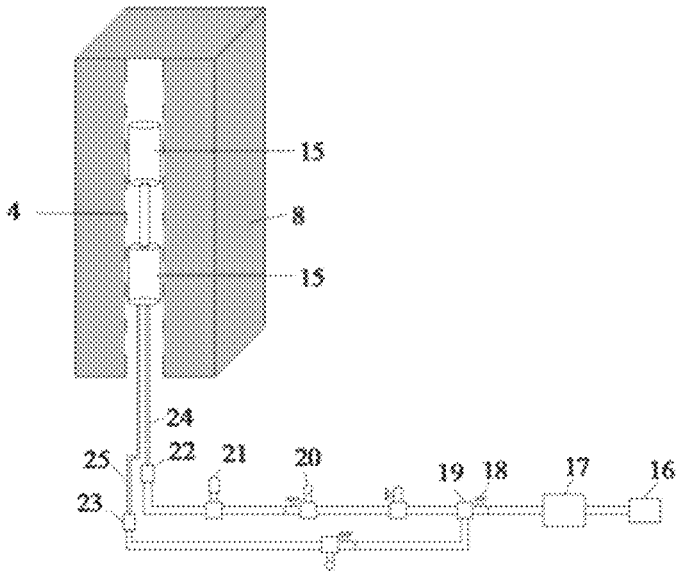
FIG. 4 is a flowchart of a fracturing process of the present disclosure.

S5: performing sectional hydraulic fracturing on the coal seam being mined 8 through the fracturing boreholes 4, turning on a pump 17 to inject high-pressure water within a water tank 16 into an inner cavity of a hole packer through a hole packer pressurizing pipe 25, and closing a way of a shut-off valve 18 to the hole packer pressurizing pipe 25 after the hole packer 15 is expanded and the pressure of the inner cavity thereof reaches a working pressure, so as to complete a hole packing operation. (As shown in FIG. 4, a tee joint 19 is arranged at the shut-off valve 18 connected behind the pump 17, one way of the tee joint 19 is connected to the hole packer pressurizing pipe 25 through a straight joint 23, and another way of the tee joint 19 is connected to a water injection fracturing pipe 24 through a diameter variable joint 22, wherein pressure gauges 20 are arranged on both the two ways of the tee joint 19, and a pressure sensor 22 is also arranged on the way connected to the water injection fracturing pipe 24). Turning on the way of the shut-off valve 18 to the water injection fracturing pipe 24 to inject the high-pressure water into a fracturing section of the coal body. The coal seam is fractured according to the designed fracturing solution. Closing the diameter variable joint after the coal seam is fractured, and then shutting down the pump 17. Opening the way of the shut-off valve to the hole packer pressurizing pipe 25, releasing the strong pressure in the hole packer, recovering the pressure of the inner cavity of the hole packer, moving the hole packer to an involved position. When the pressure of the water injection pump rises to the fracturing pressure of the coal body during constructing the fracturing process, the discharge pressure of the water injection pump is maintained to expand fractures. When the discharge pressure of the water injection pump suddenly rises from a continuously stable value to another value at which the discharge pressure does not change any longer, ending the fracturing operation of the first fracturing section.

S6: moving the fracturing equipments along the strike of the coal seam after the fracturing operation of the first fracturing section is completed. Performing the fracturing operation of a next section according to designed row spacing of the fracturing boreholes as for the first fracturing section until all of the fracturing boreholes have been performed with the fracturing operation, wherein the above operations are cycled, to complete the fracturing operations of the coal body with high elastic energy on the mining face.

S7: remaining the fracturing construction roadway 3 as a stoping roadway 3 of the fracturing level.

As shown in FIG. 1, a stoping roadway 7 of a coal seam to be mined is planned in a coal seam to be mined 9. The upper parts of the coal seam being mined and the coal seam to be mined are respectively a goaf 10 of the coal seam being mined and a goaf 12 of the coal seam to be mined. An inter-coal seam rock pillar 13 is between the coal seam being mined and the coal seam to be mined, and a floor rock layer 14 is on the other side of the coal seam to be mined.

The foregoing descriptions are preferred implementation modes of the present disclosure. It should be noted that those of ordinary skill in the art may make a number of improvements and refinements without departing from the principle of the present disclosure. These improvements and refinements should also be regarded as the scope of protection of the present disclosure.

What is claimed is:

1. Coal bump control method for sectional hydraulic fracturing regions of a near vertical ultra thick coal seam, comprising the following steps:

S1: deepening a main shaft from a mining level to a fracturing level;

S2: excavating a cross-hole from a roof rock layer of a coal seam at the fracturing level to enter the coal seam being mined, and excavating a roadway along a strike of the coal seam at the fracturing level to serve as a dedicated roadway for hydraulic fracturing construction, that is, a fracturing roadway;

S3: constructing inclined fracturing boreholes from the fracturing roadway to an upper portion of the coal seam, wherein the boreholes are ended at a center of a thickness of the upper portion of the coal seam, and an angle α and a length L of each fracturing borehole are obtained from the thickness d of the coal seam and an vertical distance H according to following formulas, $$\tan\alpha = H/\left(\frac{d}{2}\right)$$

$$L = \sqrt{H^2 + \left(\frac{d}{2}\right)^2}$$

in the formulas: α is the angle of each fracturing borehole, H is the vertical distance between the mining level of the coal seam and a goaf above the coal seam, and d is the thickness of the coal seam;

a sectional height l of each fracturing borehole is obtained by power of fracturing equipment and the length L of each fracturing borehole according to following formulas:

$$n=L/R$$

$$l=H/n$$

in the formulas: l is the sectional height of each fracturing borehole, R is a single maximum fracture radius of the fracturing equipment, n is number of fracturing sections, L is the length of each fracturing borehole, and H is the vertical distance between the mining level of the coal seam and the goaf above the coal seam;

S4: arranging the fracturing boreholes in a row spacing from a cutting hole of a stoping face to a stop line in sequence along the strike of the coal seam, wherein the row spacing of the fracturing boreholes is designed according to parameters of the fracturing equipment;

S5: operating the fracturing equipment to perform inclined sectional hydraulic fracturing on a body of the coal seam with high elastic energy in one of the fracturing boreholes;

S6: moving the fracturing equipment along the strike of the coal seam after a fracturing operation of a first fracturing section is completed, performing the fracturing operation of a next fracturing section according to the designed row spacing of the fracturing boreholes in the same manner as for the first fracturing section until all of the fracturing boreholes have been performed with the fracturing operation, to complete fracturing operations of the body of the coal seam with high elastic energy on the mining face; and S7: after the fracturing operations are completed, remaining the fracturing roadway as a stoping roadway of the fracturing level.

2. The coal bump control method for sectional hydraulic fracturing regions of a near vertical ultra thick coal seam according to claim 1, wherein in S1, deepening the main shaft to a level which has a vertical depth of 100 m away from the mining level, and weakening a high-stress of the coal seam of an overall level in advance.

3. The coal bump control method for sectional hydraulic fracturing regions of a near vertical ultra thick coal seam according to claim 1, wherein in S3, constructing the fracturing boreholes in the fracturing roadway to perform the hydraulic fracturing before stoping on a working face of a current mining stage.

4. The coal bump control method for sectional hydraulic fracturing regions of a near vertical ultra thick coal seam according to claim 1, wherein in S3, the length of each fracturing borehole makes the each fracturing borehole in communication with the goaf, a fracturing range is the overall thickness of the coal seam, and the sectional height of each fracturing borehole is 20 m under limitation of the fracturing equipment.

5. The coal bump control method for sectional hydraulic fracturing regions of a near vertical ultra thick coal seam according to claim 1, wherein in S4, the row spacing of the boreholes is arranged along the strike, and the row spacing of the boreholes is two times bigger than a fracturing radius.

6. The coal bump control method for sectional hydraulic fracturing regions of a near vertical ultra thick coal seam according to claim 1, wherein in S5, during hydraulic fracturing, when a pressure of a water injection pump rises to a fracturing pressure of the body of the coal seam, maintaining a discharge pressure of the water injection pump to expand fractures; and when the discharge pressure of the water injection pump suddenly rises from a continuously stable value to another value at which the discharge pressure does not change any longer, ending a fracturing operation of the first fracturing section.

7. The coal bump control method for sectional hydraulic fracturing regions of a near vertical ultra thick coal seam according to claim 1, wherein in S6, the fracturing operation occurs earlier than the stoping operation occurs on the working face, and the fracturing operation is at least 200 m ahead of the stoping face.

8. The coal bump control method for sectional hydraulic fracturing regions of a near vertical ultra thick coal seam according to claim 1, wherein in S7, after the fracturing operation is completed, closing the fracturing roadway after support for the fracturing roadway is strengthened such that the fracturing roadway is configured as a stoping roadway to be operated when the coal seam at the fracturing level is mined in stages, so as to reduce construction cost.

* * * * *